US008919591B2

(12) United States Patent
Cai et al.

(10) Patent No.: US 8,919,591 B2
(45) Date of Patent: Dec. 30, 2014

(54) INSULATING LID FOR A FOOD CONTAINER AND METHOD OF MAKING THE SAME

(75) Inventors: Liming Cai, West Chester, PA (US); Chris T. Bruch, Downingtown, PA (US); Ayberk Abayhan, Lake Bluff, IL (US)

(73) Assignee: Pactiv LLC, Lake Forest, IL (US)

( * ) Notice: Subject to any disclaimer, the term of this patent is extended or adjusted under 35 U.S.C. 154(b) by 322 days.

(21) Appl. No.: 13/438,051

(22) Filed: Apr. 3, 2012

(65) Prior Publication Data

US 2012/0255959 A1 Oct. 11, 2012

Related U.S. Application Data

(60) Provisional application No. 61/472,351, filed on Apr. 6, 2011.

(51) Int. Cl.

| | |
|---|---|
| ***B65D 43/03*** | (2006.01) |
| ***B65D 43/04*** | (2006.01) |
| ***B65D 43/06*** | (2006.01) |
| ***B65D 81/38*** | (2006.01) |
| ***A47J 41/00*** | (2006.01) |
| ***B65D 51/24*** | (2006.01) |
| ***B65D 43/02*** | (2006.01) |

(52) U.S. Cl.

CPC ..... *B65D 51/245* (2013.01); *B65D 43/0208* (2013.01); *B65D 2543/00092* (2013.01); *B65D 2543/00231* (2013.01); *B65D 2543/00296* (2013.01); *B65D 2543/00407* (2013.01); *B65D 2543/00509* (2013.01); *B65D 2543/00537* (2013.01); *B65D 2543/00555* (2013.01); *B65D 2543/00731* (2013.01); *B65D 2543/00796* (2013.01)

USPC ..... 220/215; 220/367.1; 220/592.2; 220/523; 206/545; 206/508; 229/403

(58) Field of Classification Search

USPC ..... 220/215, 367.1–374, 368, 792, 521, 220/592.17, 592.2, 254.7, 790, 378, 523; 206/545, 508; 229/403; 40/311

See application file for complete search history.

(56) References Cited

U.S. PATENT DOCUMENTS

| | | | | | |
|---|---|---|---|---|---|
| 2,283,448 | A | * | 5/1942 | Malek | 220/215 |
| 3,193,130 | A | * | 7/1965 | Miller | 220/374 |
| 3,360,161 | A | * | 12/1967 | Smith | 220/719 |
| 3,459,324 | A | | 8/1969 | Miller | |
| 4,213,537 | A | | 7/1980 | Caccavale | |
| 4,795,052 | A | | 1/1989 | Hayes, Jr. | |
| 4,915,250 | A | | 4/1990 | Hayes, Jr. | |
| 5,310,981 | A | * | 5/1994 | Sarnoff et al. | 219/731 |
| 5,540,350 | A | | 7/1996 | Lansky | |
| D413,631 | S | | 9/1999 | Hendler et al. | |
| 5,971,195 | A | | 10/1999 | Reidinger et al. | |
| 5,979,689 | A | | 11/1999 | Lansky | |
| 6,199,711 | B1 | | 3/2001 | Lansky | |

(Continued)

*Primary Examiner* — Fenn Mathew
*Assistant Examiner* — Jennifer Castriotta
(74) *Attorney, Agent, or Firm* — Armstrong Teasdale LLP

(57) ABSTRACT

An insulating lid includes a cover having an outer edge and a base. The base includes an upper surface, a lip projecting upwardly from the upper surface about an outer perimeter of the base to define an inner area, and a plurality of spacer members extending upwardly from the upper surface positioned within the inner area. The plurality of spacer members are configured to space the cover a distance from the upper surface of the base to define an insulating space between the cover and the upper surface of the base.

17 Claims, 7 Drawing Sheets

(56) References Cited

U.S. PATENT DOCUMENTS

| | | | |
|---|---|---|---|
| 6,311,860 | B1 | 11/2001 | Reidinger et al. |
| 6,419,112 | B1 | 7/2002 | Bruce et al. |
| 6,578,726 | B1 | 6/2003 | Schaefer |
| D500,343 | S | 12/2004 | McRobbie |
| 7,055,715 | B2 | 6/2006 | Maravich et al. |
| 7,100,787 | B2 | 9/2006 | Farnsworth et al. |
| 7,195,130 | B2 | 3/2007 | Pendergrass et al. |
| 7,318,536 | B2 | 1/2008 | Maravich et al. |
| 7,484,639 | B2 | 2/2009 | Maravich et al. |
| 7,959,029 | B2 | 6/2011 | Whitaker et al. |
| 8,074,831 | B2 | 12/2011 | Walker et al. |
| 2002/0074337 | A1 | 6/2002 | Melton |
| 2005/0035011 | A1 | 2/2005 | McRobbie |
| 2005/0035018 | A1 | 2/2005 | McRobbie |
| 2007/0075080 | A1 | 4/2007 | Farnsworth et al. |
| 2008/0041867 | A1 | 2/2008 | Jochem et al. |

* cited by examiner

INSULATING LID FOR A FOOD CONTAINER AND METHOD OF MAKING THE SAME

CROSS REFERENCE TO RELATED APPLICATIONS

This application claims the priority of U.S. Provisional Patent Application Ser. No. 61/472,351, filed Apr. 6, 2011, which is hereby incorporated by reference in its entirety.

BACKGROUND OF THE INVENTION

The subject matter described herein relates generally to an insulating lid and, more particularly, to an insulating lid for a food container and a method of making the same.

Many known containers are configured to house products that should be maintained at a temperature either below or above ambient temperature (e.g., food or beverage products), and these known containers tend to be at least partially insulated. Some of these containers are configured to insulate a product for an extended period of time (e.g., days or weeks) such that they are intended for repeated use applications (e.g., a cooler or thermos that can be used, cleaned, and stored for future use). Other known containers are used to insulate a product for a shorter period of time (e.g., a few minutes or hours) such that they are intended for disposable use applications (e.g., point-of-sale applications in which a disposable coffee cup is sold to a consumer with coffee therein or a disposable soup bowl is sold to a consumer with soup therein).

Because the containers that are typically used to insulate for extended periods of time often have a foam-filled or vacuum-sealed chamber between two adjacent sidewalls of rigid plastic or metal, these containers are generally fabricated using materials and/or processes that are more expensive such that these containers are not practical for use in disposable applications. On the other hand, the containers that are typically used for disposable applications are often fabricated from materials and using processes that are less expensive (e.g., via a thin wall of flexible plastic that may be lined on the exterior with a thin sheet of bubble-wrap or foam).

The lids of many known disposable containers tend to be rather ineffective at insulating the container, but are typically inexpensive to make. In contrast, the lids of many known reusable containers tend to be more effective at insulating the container, but can be very expensive to make. Accordingly, what is needed is an insulating lid for use with a food container that is both inexpensive to make, and sufficiently insulating such that it provides improved insulating properties that can be used in either a disposable application or a reusable application.

BRIEF DESCRIPTION OF THE INVENTION

In one aspect, an insulating lid for a container is provided. The insulating lid includes a cover having an outer edge and a base. The base includes an upper surface, a lip projecting upwardly from the upper surface about an outer perimeter of the base to define an inner area, and a plurality of spacer members extending upwardly from the upper surface positioned within the inner area. The plurality of spacer members are configured to space the cover a distance from the upper surface of the base to define an insulating space between the cover and the upper surface of the base.

In another aspect, a base for use with an insulating lid for use with a container is provided. The base includes an upper surface, a lip projecting upwardly from the upper surface about an outer perimeter of the base to define an inner area, and a plurality of spacer members extending upwardly from the upper surface positioned within the inner area. The plurality of spacer members are configured to space a cover a distance from the upper surface of the base to define an insulating space between the cover and the upper surface of the base.

In yet another aspect, a method for assembling an insulating lid for a container. The lid includes a cover and a base. The base includes an upper surface, a lip projecting upwardly from the upper surface and extending around an outer perimeter of the base to define an inner area, and a plurality of spacer members extending upwardly from the upper surface positioned within the inner area. The method includes positioning the cover over the plurality of spacer members of the base to define an insulating space between the cover and the upper surface of the base, and coupling the cover to the base to form the lid.

DETAILED DESCRIPTION OF THE INVENTION

Figure 1:
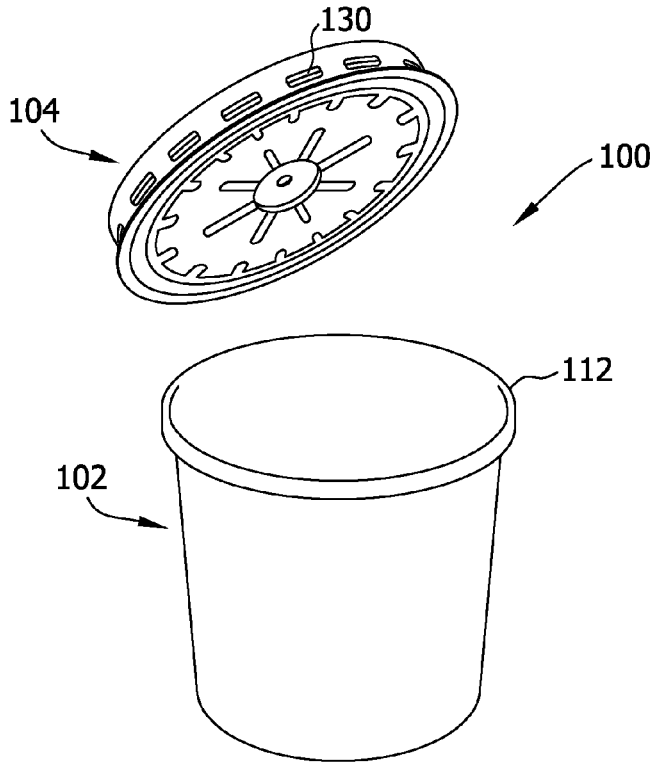
FIG. 1 is an exploded perspective view of an exemplary embodiment container system having a container and a lid.

The exemplary embodiments described herein provide an insulating lid with improved insulating properties that can be inexpensively manufactured for either a disposable food container or a reusable food container. A method of making the improved insulating lid is also described herein. The lid described herein is configured to create an air gap or air pocket between a lower layer and an upper layer of the lid. Heated or cooled air from within the food container is channeled into the air pocket. This air gap helps to provide the lid with its improved insulating properties. In addition, the lid can be manufactured from a combination of plastic and paperboard materials making it relatively inexpensive to make. Thus, the embodiments of the lid described herein provide improved insulating properties such that the lids can be used with a reusable food container, and since these lids are inexpensive to make, they can also be used with disposable food containers. For the purposes of this patent application, the example embodiment of the lid will be described in the context of being used with a disposable container. However, as explained above, the lid could also be used with reusable containers.

The example embodiment of the lid includes a base portion and a cover portion. The base portion is typically manufactured from a plastic material, and is formed unitarily as one-piece. The base portion includes an upwardly projecting annular lip extending around an outer perimeter of the base portion and a plurality of upwardly projecting spacer members extending within an inner area of the base portion. The spacer member can include ribs, support ribs, dimples, and/or any other suitable member that facilitates forming an air pocket, as described in more detail herein. The annular lip has a top side and a bottom side. The bottom side of the annular lip is configured to receive an upper rim of a container for removably coupling or attaching the lid to the container. In one embodiment, the annular lip includes a retaining groove on the top side for at least partially securing the cover. In another embodiment, the annular lip includes a retainer rib projecting upwardly from the top side for receiving an outer peripheral portion of the cover. In both embodiments, the cover is sized to cover substantially all of an upper surface of the base.

In one embodiment, a set of first ribs, which may or may not support a cover thereon, extend radially inwardly from the annular lip toward a center of the base. In another embodiment, the set of first ribs, which may or may not support a cover thereon, extend radially inwardly from an annular support rib that is spaced radially inwardly from the annular lip. In both embodiments, a set of second ribs, which may or may not support a cover thereon, extend radially outwardly from a central hub of the base. The ribs are configured to maintain the cover in a spaced relationship relative to the upper surface of the base, thereby defining an air pocket between the cover and the base.

A vent, such as a hole or a flap, is defined within the central hub of the base to facilitate releasing steam from the container into the air pocket when the lid is coupled to the container, and a pair of diametrically opposed vents are also formed in the cover to provide an outlet for steam that enters the air pocket through the vent of the base. The cover is configured to be above the container's flush fill and to be glued, plugged, and/or otherwise mechanically fastened to the annular lip. The base is configured such that the cover vent register may not be used during assembly of the lid. In one embodiment, the thickness of the cover may be sized to enable support ribs of the base to contact the cover, thereby maintaining the cover in spaced apart relationship with respect to the base. In another embodiment, the spacer members may be spaced apart from the cover to facilitate supporting the cover in the event that a portion of the cover is displaced downward toward the base.

In another embodiment, the lid includes any combination and/or pattern of spacer members extending upwardly from the base to facilitate maintaining the cover in a spaced relationship relative to the upper surface of the base, thereby defining an air pocket between the cover and the base. The air pocket helps to provide at least some of the improved insulating properties of the lid. In addition, the base vent hole and the cover vents facilitate reducing an increased pressure that may build up within the container when the container includes a hot food product, and allow for compressed air to escape the container when the lid is secured to the container.

FIG. 1 is an exploded perspective view of an exemplary container system 100. Container system 100 includes a container 102 and a lid 104. Container 102 has an upper rim 112 and is configured to contain a product (e.g., a food product or a beverage) at a temperature above or below ambient temperature, and container 102 may be suitably insulated to facilitate maintaining a temperature of the product within container system 100 for a desired period of time. Lid 104 is configured to be detachably coupled to container 102 in a manner that substantially seals the product within container system 100. Lid 104 helps to prevent the product from spilling out of container system 100 when lid 104 is coupled to container 102, and limits air (e.g., steam) from within container system 100 from flowing outside of container system 100 causing a temperature change of the product contained within container 102. In another embodiment, container 102 may have any suitable size and/or shape configured for containing any suitable product, and lid 104 may be detachably coupled to container 102 in any suitable manner that facilitates enabling lid 104 to function as described herein.

Figure 2:
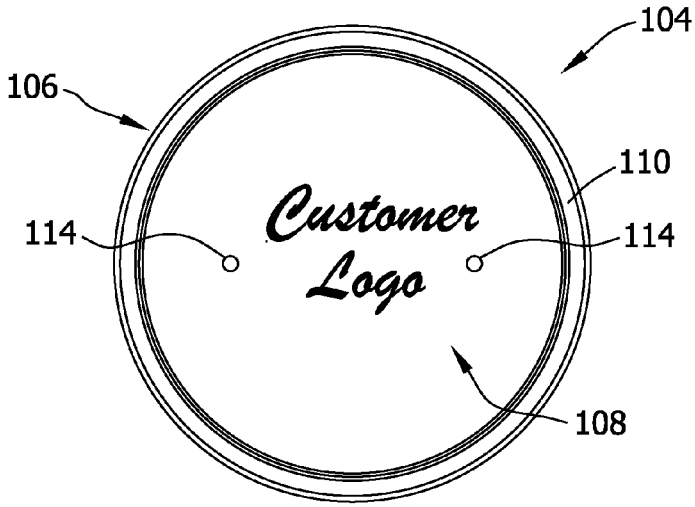
FIG. 2 is a top view of an exemplary embodiment of a lid that may be used with the container system shown in FIG. 1.

FIG. 2 is a top view of lid 104 detached from container 102. Lid 104 has a base 106 and a cover 108 coupled to base 106. Base 106 includes an annular lip 110 configured to receive upper rim 112 of container 102 for detachably coupling lid 104 to container 102 to substantially seal container system 100. Cover 108 is coupled to base 106 such that lip 110 circumscribes cover 108, and cover 108 includes a pair of diametrically opposed vent holes 114 to facilitate ventilating container system 100, as described in more detail below. Alternatively, cover 108 may have any suitable number of vent holes 114 arranged in any suitable manner. In the exemplary embodiment, lid 104 is generally circular in shape, but lid 104 may be any suitable shape in other embodiments. In the exemplary embodiment, base 106 is integrally formed from a synthetic or semi-synthetic, organic-based material (e.g., a "plastic" material) using a molding process, and cover 108 is fabricated from a paper material. It is understood, however, that base 106 and/or cover 108 may be fabricated from any suitable materials using any suitable manufacturing processes.

Figure 3:
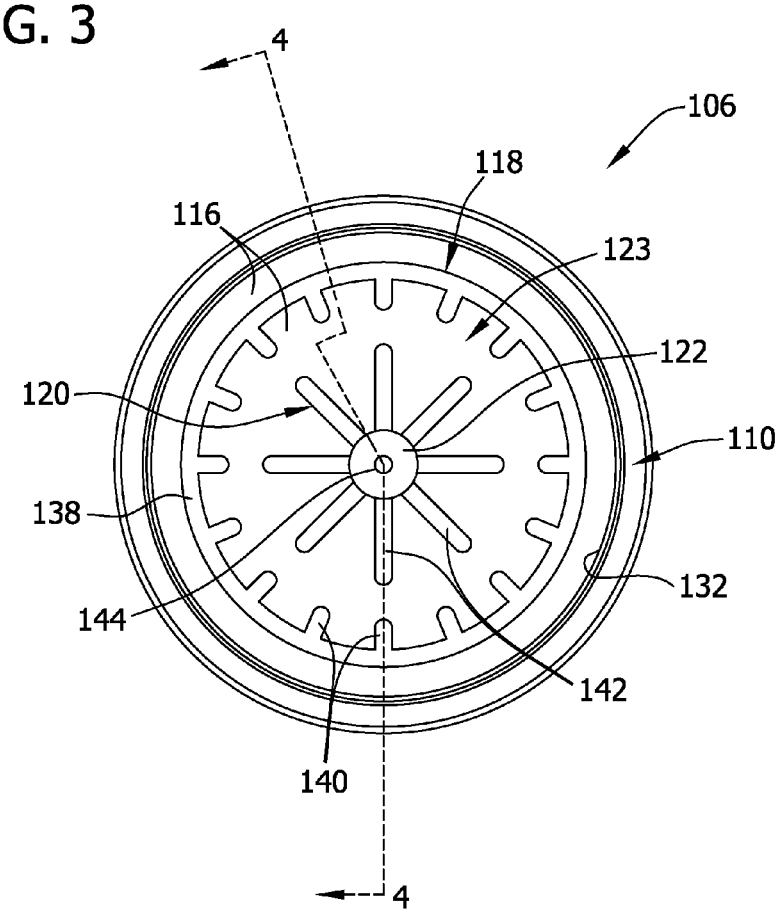
FIG. 3 is a top view of a base portion of the lid shown in FIG. 2 with a cover portion removed from the lid.
Figure 4:
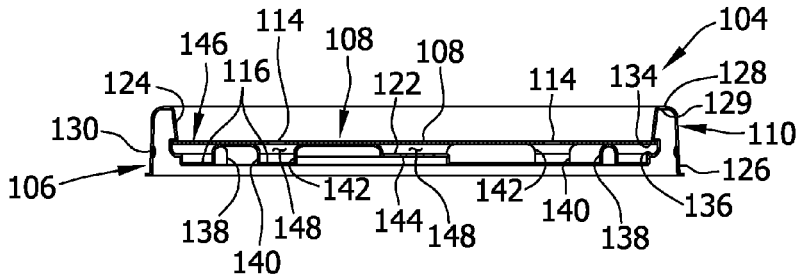
FIG. 4 is a cross-sectional view of the lid shown in FIG. 2 taken along line 4-4 of FIG. 3.

FIG. 3 is a top view of base 106 with cover 108 removed, and FIG. 4 is a cross-sectional view of lid 104 taken along line 4-4 with cover 108 present. In the exemplary embodiment, base 106 is generally circular and includes an upper surface 116, lip 110 projecting upwardly from upper surface 116, an outer array 118 of spacer members projecting from upper surface 116, an inner array 120 of spacer members projecting from upper surface 116, and a central hub 122 projecting from upper surface 116. The spacer members include ribs and/or support ribs. Lip 110 projects upwardly from upper surface 116 about an outer perimeter of base 106 to define an inner area 123. Lip 110 has an inner surface 124, an outer surface 126, an upper side 128, and a bottom side 129. Bottom side 129 is configured to receive upper rim 112 of container 102. In the exemplary embodiment, a plurality of circumferentially spaced indentations 130 (FIGS. 1 and 4) are formed in outer surface 126, and a retaining groove 132 is formed in inner surface 124. Retaining groove 132 is spaced apart from upper surface 116 and includes a top surface 134 and a bottom surface 136. In other embodiments, retaining groove 132 may have any suitable shape and location relative to upper surface 116.

In the exemplary embodiment, outer array 118 includes an annular rib 138 and a plurality of radial ribs 140 that extend radially inwardly from annular rib 138. Annular rib 138 is spaced radially inwardly from lip 110, and radial ribs 140 are circumferentially spaced apart from one another about annular rib 138. In one embodiment, outer array 118 includes sixteen radial ribs 140. In other embodiments, outer array 118 may have any suitable number of radial ribs 140.

In the exemplary embodiment, inner array 120 includes a plurality of radial ribs 142 that are circumferentially spaced apart from one another about central hub 122. Rib 138, ribs 140, and/or ribs 142 may or may not be support ribs. Each radial rib 142 of inner array 120 is substantially co-radially aligned with one radial rib 140 of outer array 118 such that every other radial rib 140 has a corresponding radial rib 142. In the exemplary embodiment, each radial rib 142 is longer than, and spaced apart from, its corresponding radial rib 140. In other embodiments, inner array 120 may include any suitable number of ribs 142 aligned in any suitable manner and having any suitable length relative to ribs 140. In the exemplary embodiment, radial ribs 142 extend from and are at least partially integrally formed with central hub 122. Ribs 142 of inner array 120 and ribs 138, 140 of outer array 118 project to substantially the same height above upper surface 116 and below top surface 134 of retaining groove 132. While inner array 120 includes eight radial ribs 142 in the exemplary embodiment, inner array 120 may have any suitable number of radial ribs 142 in other embodiments. In alternative embodiments, base 106 may include any number of ribs 138, 140, 142 having any suitable contours and/or orientations (e.g., ribs 140, 142 may be curvilinearly oriented and may not be radially oriented).

In the exemplary embodiment, central hub 122 has a vent, such as vent hole 144, formed in the central region thereof, and vent hole 144 extends through base 106 to facilitate ventilating (e.g., releasing steam from) container system 100 when lid 104 is coupled to container 102. In other embodiments, central hub 122 may include any suitable number of vent holes 144 and/or vent flaps arranged in any suitable manner. Alternatively, vent hole(s) 144 may be located on any suitable segment of base 106 (e.g., vent holes 144 may not be formed in central hub 122). In the exemplary embodiment, central hub 122 does not project to the height of radial ribs 142 such that central hub 122 is recessed relative to radial ribs 142.

In the assembled configuration of lid 104, cover 108 is fastened to base 106 above ribs 138, 140, 142 with a peripheral portion 146 of cover 108 received within retaining groove 132 of lip 110. In some embodiments, cover 108 may be fastened to top surface 134 or bottom surface 136 of retaining groove 132 (e.g., via an adhesive or any other suitable fastener). In other embodiments, cover 108 may not be fastened to retaining groove 132 (e.g., cover 108 may be detachable from base 106 by simply removing peripheral portion 146 of cover 108 from retaining groove 132). When peripheral portion 146 of cover 108 is inserted into retaining groove 132, remaining segments of cover 108 (e.g., central segments of cover 108) are seated above and/or on ribs 138, 140, 142 such that cover 108 is maintained and/or supported in a spaced apart relationship relative to upper surface 116, thereby defining an air pocket 148 between cover 108 and upper surface 116 within annular rib 138 to facilitate insulating container system 100 and maintaining a temperature of the product within container system 100. When ribs 138, 140, and/or 142 are support ribs, ribs 138, 140, and/or 142 apply an upward force on cover 108 while top surface 134 applies a downward force for securing cover 108 to base 106.

Because air is permitted to flow through the spaces between radial ribs 142 of inner array 120 and into the area above central hub 122, air can flow between air pocket 148 and sealed container system 100 (e.g., steam can be released from container system 100 into air pocket 148 through vent hole 144 of base 106, thereafter exiting air pocket 148 through vent holes 114 of cover 108). Since base 106 may be fabricated from a thin layer of plastic and cover 108 may be fabricated from a thin layer of paper material, and since air is used to facilitate insulating lid 104, lid 104 may be fabricated in a less expensive manner, thereby rendering lid 104 more suitable for disposable (e.g., point-of-sale or one-time-use) applications. Alternatively, lid 104 may be fabricated from materials and using processes that render lid 104 more suitable for repeated use applications in other embodiments. Also, because cover 108 may be fabricated from a paper material, cover 108 may include marketing indicia (e.g., logos and/or slogans) printed on cover 108 to suit a particular vendor. Cover 108 is also configured for easy fastening to base 106, thereby enabling a single configuration of base 106 to be used with various, customized covers 108 to decrease manufacturing costs associated with fabricating and assembling customized lids 104 for disposable, insulated containers.

Figure 5:
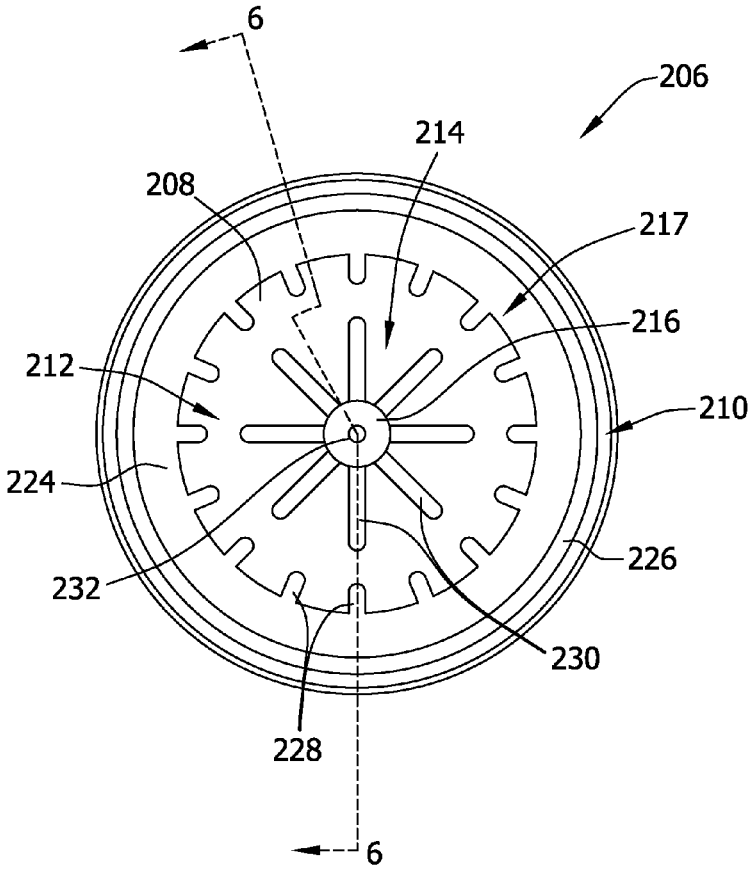
FIG. 5 is a top view of a first alternative embodiment of a base portion of a first alternative embodiment of the lid shown in FIG. 6 with a cover portion removed from the lid.
Figure 6:
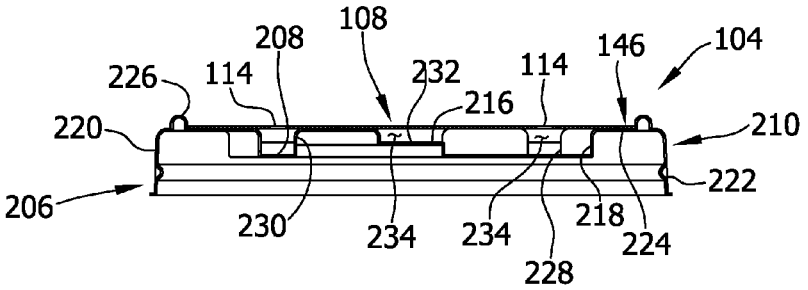
FIG. 6 is a cross-sectional view of the first alternative embodiment of the lid shown in FIG. 5 and taken along line 6-6 of FIG. 5.

FIG. 5 is a top view of an alternative embodiment of a base 206 with cover 108 removed, and FIG. 6 is a cross-sectional view of lid 104 having base 206 (rather than base 106) and taken along line 6-6 with cover 108 present. Base 206 is generally circular and includes an upper surface 208, an annular lip 210 projecting from upper surface 208, an outer array 212 of spacer members projecting from upper surface 208, an inner array 214 of spacer members projecting from upper surface 208, and a central hub 216 projecting from upper surface 208. More specifically, lip 210 projects upwardly from upper surface 208 about an outer perimeter of base 206 to define an inner area 217. Lip 210 has an inner surface 218, an outer surface 220, an annular indentation 222 formed on outer surface 220, an annular rib 224 defining inner surface 218, and an annular retainer rib 226 projecting upward from annular rib 224. In this embodiment, outer array 212 includes a plurality of radial ribs 228 that are at least partially integrally formed with and extend radially inwardly from lip 210, and radial ribs 228 are circumferentially spaced apart from one another about lip 210 and/or annular support rib 224. In one embodiment, outer array 212 includes sixteen radial ribs 228. In other embodiments, outer array 212 may have any suitable number of radial ribs 228.

Inner array 214 includes a plurality of radial ribs 230 that are circumferentially spaced apart from one another about central hub 216. Ribs 224, 228, and/or 230 may or may not include support ribs. Each radial rib 230 of inner array 214 is substantially co-radially aligned with one radial rib 228 of outer array 212 such that every other radial rib 228 has a corresponding radial rib 230. In this embodiment, each radial rib 230 is longer than, and spaced apart from, its corresponding radial rib 228. In other embodiments, inner array 214 may include any suitable number of ribs 230 and/or spacer members aligned in any suitable manner and having any suitable length relative to ribs 228 of outer array 212. In this embodiment, radial ribs 230 extend from and are at least partially integrally formed with central hub 216. Radial ribs 230 of inner array 214, radial ribs 228 of outer array 212, and annular rib 224 are substantially the same height above upper surface 208. While inner array 214 includes eight radial ribs 230 in this embodiment, inner array 214 may have any suitable number of radial ribs 230 in other embodiments. In alternative embodiments, base 206 may include any suitable number of ribs 228, 230, and/or 224 having any suitable contours and/or orientations (e.g., radial ribs 228 and/or 230 may be curvilinearly oriented rather than radially oriented).

Central hub 216 has a vent, such as a vent flap and/or a vent hole 232, formed in a central region thereof, and vent hole 232 extends through base 206 to facilitate ventilating (e.g., releasing steam from) container system 100 when lid 104 is coupled to container, as described above. In other embodiments, central hub 216 may include any suitable number of vent holes 232 and/or other suitable vents arranged in any suitable manner. Alternatively, vent hole(s) 232 may be located on any suitable region of base 206 (e.g., vent holes 232 may not be formed in central hub 216). In the exemplary embodiment, central hub 216 does not project to the height of radial ribs 230 of inner array 214 such that central hub 216 is recessed relative to radial ribs 230 of inner array 214.

In the assembled configuration of lid 104 using base 206, cover 108 is fastened to base 206 above ribs 228 and/or 230 with peripheral portion 146 of cover 108 fastened and/or couple to annular support rib 224 within retainer rib 226 (e.g., via an adhesive). When peripheral portion 146 of cover 108 is fastened and/or coupled to annular support rib 224, remaining segments of cover 108 (e.g., central segments of cover 108) are seated on and/or positioned above ribs 228 and/or 230 such that cover 108 is supported and/or maintained in a spaced apart relationship relative to upper surface 208, thereby defining an air pocket 234 between cover 108 and upper surface 208 within lip 210 to facilitate insulating container system 100 and maintaining a temperature of the product within container system 100. Like base 106, air is permitted to flow through the spaces between radial ribs 230 of base 206 and into the area above recessed central hub 216, and air can flow between air pocket 234 and sealed container system 100 via vent hole 232 (e.g., steam can be released from container system 100 through vent hole 232 of base 206 and can exit air pocket 234 through vent holes 114 of cover 108).

Figure 7:
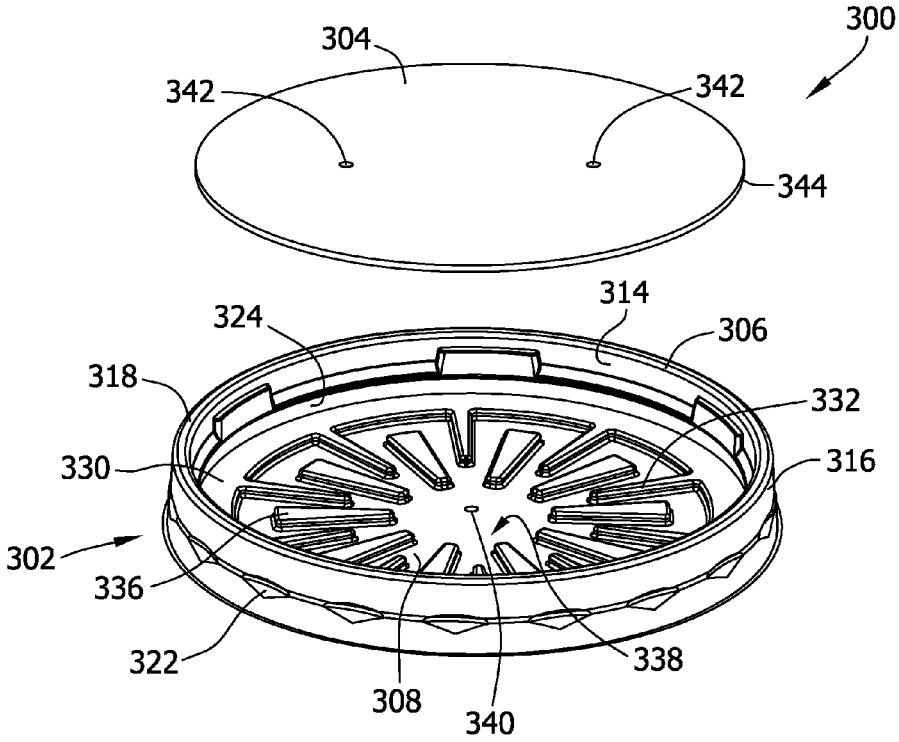
FIG. 7 is an exploded perspective view of a second alternative embodiment of a lid that may be used with the container shown in FIG. 1.
Figure 8:
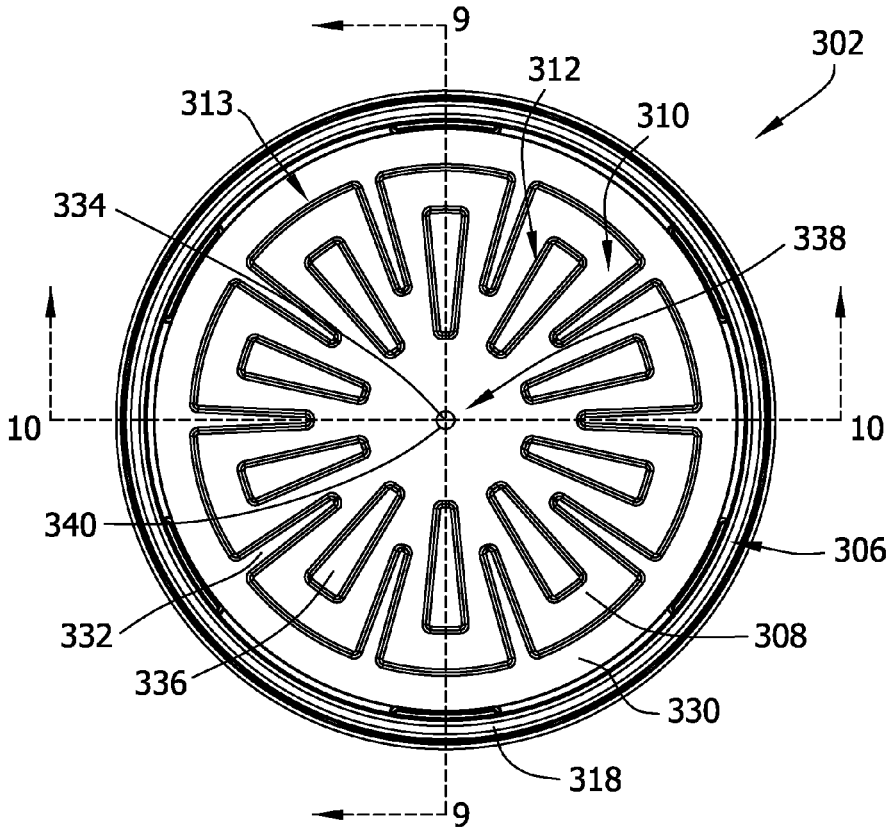
FIG. 8 is a top view of the lid shown in FIG. 7 with a cover removed.
Figure 9:
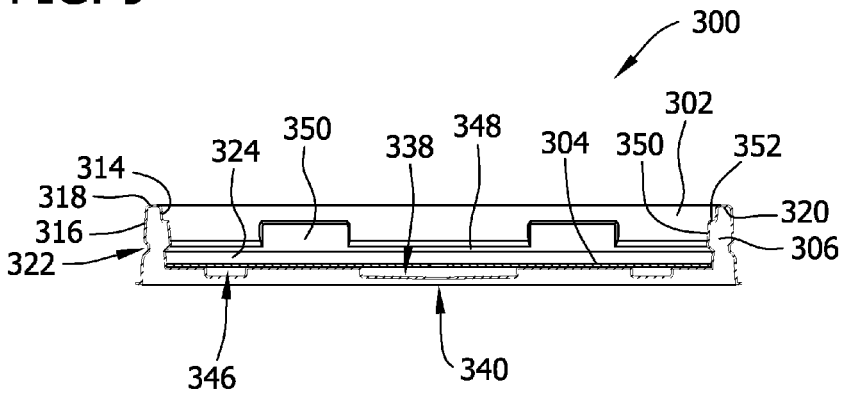
FIG. 9 is a cross-sectional view of the lid shown in FIGS. 7 and 8 taken at line 9-9 of FIG. 8 with the cover included.
Figure 10:
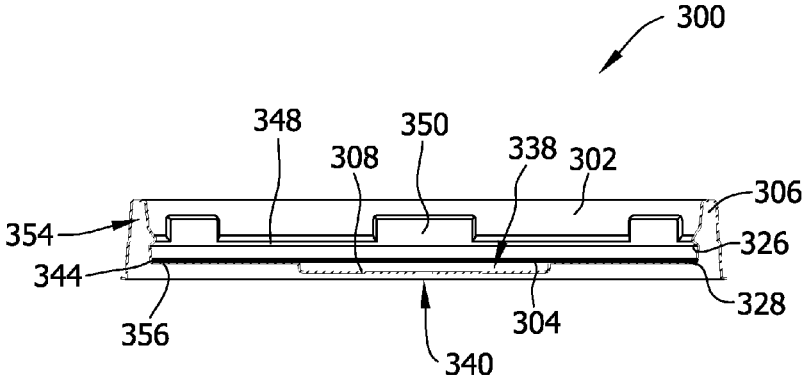
FIG. 10 is a cross-sectional view of the lid shown in FIGS. 7 and 8 taken at line 10-10 of FIG. 8 with the cover included.

FIG. 7 is an exploded perspective view of a second alternative lid 300 that may be used with container 102 (shown in FIG. 1). FIG. 8 is a top view of lid 300 with a cover removed. FIG. 9 is a cross-sectional view of lid 300 taken at line 9-9 of FIG. 8 with the addition of the cover. FIG. 10 is a cross-sectional view of lid 300 taken at line 10-10 of FIG. 8 with the addition of the cover. In FIGS. 9 and 10, additional radial ribs are excluded for clarity.

Lid 300 has a base 302 and a cover 304 coupled to base 302. Cover 304 can be similar to cover 108 (shown in FIG. 2), described in more detail above. Base 302 includes an annular lip 306 configured to receive upper rim 112 (shown in FIG. 1) of container 102 for detachably coupling lid 300 to container 102 to substantially seal container system 100 (shown in FIG. 1). Cover 304 is coupled to base 302 such that lip 306 circumscribes cover 304. In the exemplary embodiment, lid 300 is generally circular in shape, but lid 300 may be any suitable shape in other embodiments. In the exemplary embodiment, base 302 is integrally formed from a synthetic or semi-synthetic, organic-based material (e.g., a "plastic" material) using a molding process, and cover 304 is fabricated from a paper material. It is understood, however, that base 302 and/or cover 304 may be fabricated from any suitable materials using any suitable manufacturing processes.

Base 302 includes an upper surface 308, lip 306 projecting upwardly from upper surface 308, an outer array 310 of spacer members projecting from upper surface 308, and an inner array 312 of spacer members projecting from upper surface 308. More specifically, lip 306 projects upwardly from upper surface 308 about an outer perimeter of base 302 to define an inner area 313. Lip 306 has an inner surface 314, an outer surface 316, an upper side 318, and a bottom side 320. Bottom side 320 is configured to receive upper rim 112 of container 102. In the exemplary embodiment, a plurality of circumferentially spaced indentations 322 are formed in outer surface 316, and a retaining groove 324 is formed in inner surface 314. Retaining groove 324 is below upper side 318 and spaced apart from upper surface 308. Retaining groove 324 includes a top surface 326 and a bottom surface 328. In other embodiments, retaining groove 324 may have any suitable shape and location relative to upper surface 308 and/or upper side 318.

In the exemplary embodiment, outer array 310 includes an annular rib 330 and a plurality of radial ribs 332 that extend radially inwardly from annular rib 330. Annular rib 330 extends radially inwardly from lip 306 and is adjacent to lip 306. Annular rib 330 extends into groove 324. Radial ribs 332 are circumferentially spaced apart from one another about annular rib 330 and each extend from annular rib 330 toward a center 334 of base 302. In one embodiment, outer array 310 includes ten radial ribs 332. In other embodiments, outer array 310 may have any suitable number of radial ribs 332.

In the exemplary embodiment, inner array 312 includes a plurality of radial ribs 336 that are circumferentially spaced apart from one another and extend radially with respect to center 334. Ribs 330, 332, and/or 336 may or may not be support ribs. Radial ribs 336 are spaced a distance from center 334. Each radial rib 336 of inner array 312 is positioned between adjacent radial ribs 332 of outer array 310. In other embodiments, inner array 312 may include any suitable number of ribs 336 aligned in any suitable manner and having any suitable length relative to outer radial ribs 332. In the exemplary embodiment, each radial rib 336 is wider than each outer radial rib 332. Further, each inner radial rib 336 is spaced apart from adjacent outer radial ribs 332 and annular rib 330. As such, each inner radial rib 336 is in not in contact with any other rib 336, 332, and/or 330.

Ribs 336 of inner array 312 and ribs 330 and 332 of outer array 310 project to substantially the same height above upper surface 308 as bottom surface 328 retaining groove 324. As such ribs 330, 332, and 336 have a height that is below top surface 326 of retaining groove 324. In alternative embodiments, base 302 may include any number of ribs 330, 332, and/or 336 having any suitable contours and/or orientations (e.g., ribs 332 and/or 336 may be curvilinearly oriented and may not be radially oriented).

In the exemplary embodiment, a recess or reservoir 338 is defined about center 334 of base 302 by radial ribs 332 and/or 336. A vent, such as a vent flap and/or a vent hole 340, is defined at or near center 334 and extends through base 302 to facilitate ventilating (e.g., releasing steam from) and/or draining (e.g., channeling liquid into) container system 100 when lid 300 is coupled to container 102. In other embodiments, base 302 may include any suitable number and/or type of vents arranged in any suitable manner. Alternatively, vent hole(s) 340 may be located on any suitable segment of base 302 (e.g., vent holes 340 may not be formed in reservoir 338). In the exemplary embodiment, holes 342 defined in cover 304 do not align with vent hole 340 to facilitate preventing spillage from container 102 through vent hole 340 and a cover hole 342. Further, reservoir 338 is configured to capture any liquid or condensed steam that has passed through vent hole 340. More specifically, upper surface 308 of base 302 is contoured to direct liquid and/or condensate toward center 334 and/or reservoir 338. For example, upper surface 308 is slightly sloped from lip 306 downward toward center 334. Vent hole 340 is configured to channel the liquid and/or the condensate from reservoir 338 back into container 102.

In the assembled configuration of lid 300, cover 304 is fastened to base 302 above ribs 330, 332, and/or 336 with a peripheral portion, including an outer edge 344, of cover 304 received within retaining groove 324 of lip 306. In some embodiments, cover 304 may be fastened to top surface 326 or bottom surface 328 of retaining groove 324 (e.g., via an adhesive or any other suitable fastener). In other embodiments, cover 304 may not be fastened to retaining groove 324 (e.g., the cover may be detachable from base 302 by simply removing the peripheral portion of cover 304 from retaining groove 324). When the peripheral portion of cover 304 is inserted into retaining groove 324, remaining segments of cover 304 (e.g., central segments of cover 304) are seated on and/or positioned above ribs 330, 332, and/or 336 such that cover 304 is supported and/or maintained in a spaced apart relationship relative to upper surface 308, thereby defining an air pocket 346 between cover 304 and upper surface 308 within annular support rib 330 to facilitate insulating container system 100 and maintaining a temperature of the product within container system 100. When ribs 330, 332, and/or 336 are support ribs, ribs 330, 332, and/or 336 apply an upward force on cover 304 while top surface 326 applies a downward force for securing cover 304 to base 302.

Because air is permitted to flow through the spaces between radial ribs 336 of inner array 312 and into the area above reservoir 338, air can flow between the air pocket and sealed container system 100 (e.g., steam can be released from container system 100 into air pocket 346 through vent hole 340 of base 302, thereafter exiting air pocket 346 through vent holes 342 of cover 304). Because base 302 can be fabricated from a thin layer of plastic and cover 304 can be fabricated from a thin layer of paper material, and because air is used to facilitate insulating lid 300, lid 300 may be fabricated in a less expensive manner, thereby rendering lid 300 more suitable for disposable (e.g., point-of-sale or one-time-use) applications. Alternatively, lid 300 may be fabricated from materials and using processes that render lid 300 more suitable for repeated use applications in other embodiments. Also, because cover 304 can be fabricated from a paper material, cover 304 may include marketing indicia (e.g., logos and/or slogans) printed on cover 304 to suit a particular vendor. Cover 304 is also configured for easy fastening to base 302, thereby enabling a single configuration of base 302 to be used with various, customized covers to decrease manufacturing costs associated with fabricating and assembling customized lids 300 for disposable, insulated containers.

Figure 11:
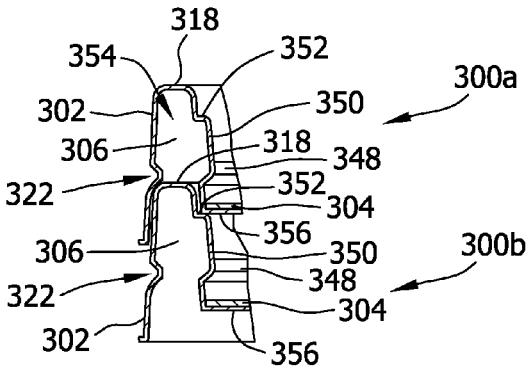
FIG. 11 is a partial cross-sectional view of two of the lids shown in FIGS. 7-10 stacked.

FIG. 11 is a partial cross-sectional view of two of lids 300*a* and 300*b* in a stack taken at a cross-section similar to line 9-9 shown in FIG. 8. More specifically, lid 300 is configured to nest with other lids 300 to form the stack. Further, lid 300 includes stacking features that allow lids 300 to be easily removed from the stack. Referring to FIGS. 9-11, lid 300 includes an annular ridge 348 extending inwardly from inner surface 314 of lip 306. A bottom surface of annular ridge 348 defines top surface 326 of groove 324. At least one lug 350 extends upwardly from ridge 348 and inwardly from lip inner surface 314. In the exemplary embodiment, a plurality of lugs 350 are circumferentially spaced about inner surface 314 and extend upward from ridge 348. Lugs 350 are configured to facilitate nesting and de-nesting of lids 300 when lids 300 are stacked and unstacked, respectively.

Referring to FIG. 11, each lug 350 includes a top surface 352. In the exemplary embodiment, lug 350 is substantially rectangular-shaped; however, lug 350 can have any suitable shape that enables lug 350 to function as described herein. Top surface 352 of lug 350 is configured to support an upper lid 300*a* when lids 300*a* and 300*b* are stacked. More specifically, lip 306 of lower lid 300*b* is inserted into a space 354 defined by lip 306 of upper lid 300*a* to nest lids 300*a* and 300*b*. A bottom surface 356 of upper lid 300*a* contacts top surface 352 of lugs 350 of lower lid 300*b* when lids 300*a* and 300*b* are nested. Indentation 322 of upper lid 300*a* can rest on upper side 318 of lip 306 of lower lid 300*b*.

Figure 12:
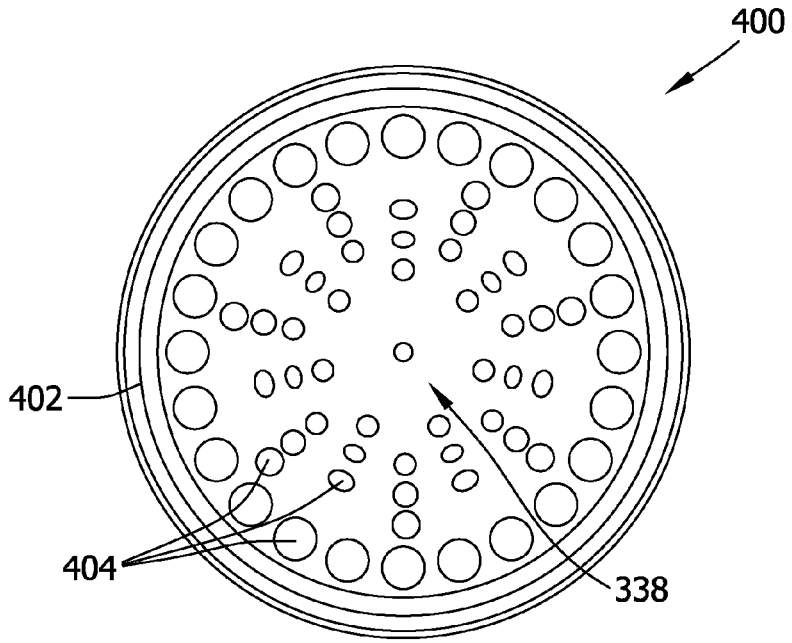
FIG. 12 is a top view of a third alternative embodiment of a lid that may be used with the container shown in FIG. 1.

FIG. 12 is a top view of a third alternative lid 400 that may be used with container 102 (shown in FIG. 1). A base 402 is shown in FIG. 12, but the cover is not shown in FIG. 12. Base 402 is substantially similar to base 303 (shown in FIGS. 7-11), except base 402 includes dimples as spacer members. More specifically, base 402 includes a plurality of dimples 404, rather than solid portions of raised material that define ribs 330, 332, and 336 (all shown in FIGS. 7 and 8). As such, base 402 includes reservoir 338, as described in more detail above. Further, it should be understood that base 106 (shown in FIGS. 3 and 4) and/or base 206 (shown in FIGS. 5 and 6) can include dimples and/or any other suitable spacer member, rather than solid portions of raised material forming ribs as shown in FIGS. 3-6.

The methods and systems described herein therefore facilitate providing a lid with an air pocket for insulating a container and maintaining a temperature of a product within the container. The methods and systems described herein also facilitate providing a lid that enables steam from a heated food product to be released from the container and channeled by the lid to an air pocket positioned between the base and the cover. The heated air pocket creates an insulated air barrier between the base and the cover resulting an improved insulated lid. The methods and systems described herein further facilitate providing a base that may be fabricated from a thin layer of plastic, a cover that may be fabricated from a thin layer of paper material, and a lid that may be insulated using air heated by the product contained in the container, thereby enabling the lid to be fabricated in a less expensive manner and rendering the lid more suitable for disposable (e.g., point-of-sale or one-time-use) applications. Additionally, the methods and systems described herein facilitate providing a lid having a base that may be easily assembled with various, customized covers, thereby decreasing a manufacturing cost associated with fabricating customized lids for disposable, insulated containers. The lid may also be used with a reusable container.

In one aspect, an insulating lid for a container is provided. The lid includes a cover having an outer edge. The lid also includes a base having an upper surface, a lip projecting upwardly from the upper surface and extending around an outer perimeter of the base to define an inner area, and a set of support ribs extending upwardly from the upper surface positioned within the inner area. The lip includes a retaining groove configured to receive the outer edge of the cover and secure the cover to the base. The set of support ribs are configured to space the cover from the upper surface for creating an insulating space between the cover and the upper surface of the base. In one embodiment, the base includes at least one vent hole for channeling air from within the container to the insulating space, wherein the channeled air is at least one of above and below ambient temperature.

In another aspect, a method for assembling an insulating lid for a container is provided. The method includes providing a base having an upper surface, a lip projecting upwardly from the upper surface and extending around an outer perimeter of the base to define an inner area, and a set of support ribs extending upwardly from the upper surface positioned within the inner area. The lip includes a retaining groove. The method also includes providing a cover having an outer edge and coupling the cover to the base, wherein the outer edge of the cover is received within the retaining groove to secure the cover to the base and wherein the set of support ribs space the cover from the upper surface creating an insulating space between the cover and the upper surface of the base.

Exemplary embodiments of a container lid are described above in detail. The container lid described herein is not limited to the specific embodiments described herein, but rather, components of the lid may be utilized independently and separately from one another. For example, the lid described herein may have other applications not limited to disposable food and beverage containers, as described herein. Rather, the lid described herein can be implemented and utilized in connection with various other industries. Moreover, the container system described above is described as containing a product that has been heated above ambient temperature such that the insulated lid helps maintain the product at the heated temperature. Alternatively, the container system could be used for storing a product that has been cooled below ambient temperature or even frozen such that the insulated lid would help maintain the product at the cooled temperature.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An insulating lid for a container comprising:

a cover comprising an outer edge; and a base comprising:

an upper surface;

a lip projecting upwardly from the upper surface about an outer perimeter of the base to define an inner area; and a plurality of spacer members extending upwardly from the upper surface positioned within the inner area, the plurality of spacer members configured to space the cover a distance from the upper surface of the base to define an insulating space between the cover and the upper surface of the base, wherein the plurality of spacer members comprise:

an annular rib;

an array of outer radial ribs extending from the annular rib; and an array of inner radial ribs positioned inwardly with respect to the outer radial ribs.

2. An insulating lid in accordance with claim 1, wherein the base comprises at least one vent configured to channel air from within the container to the insulating space.

3. An insulating lid in accordance with claim 1, wherein the lip further comprises a retaining groove configured to receive the outer edge of the cover to secure the cover to the base.

4. An insulating lid in accordance with claim 1, wherein the base further comprises a central hub, the inner radial ribs extending outwardly from the central hub toward the annular rib.

5. An insulating lid in accordance with claim 1, wherein the base further comprises a reservoir defined about a center of the base, the inner radial ribs spaced a distance from the center of the base.

6. An insulating lid in accordance with claim 1, wherein at least one of the annular rib, the outer radial ribs, and the inner radial ribs comprises at least one support rib.

7. An insulating lid in accordance with claim 1, wherein the base further comprises an annular retainer rib projecting upwardly from the annular rib, the annular retainer rib configured to substantially circumscribe the outer edge of the cover when the cover is coupled to a top surface of the annular rib.

8. An insulating lid in accordance with claim 1, wherein the insulating lid is a first insulating lid, and wherein the base further comprises:

an annular ridge defined about an inner surface of the lip and extending inwardly from the inner surface;

at least one lug extending inwardly from the inner surface of the lip and upwardly from the annular ridge, the at least one lug configured to contact a bottom surface of a second insulating lid when the second insulating lid is stacked on top of the first insulating lid.

9. A base for use with an insulating lid for use with a container, the base comprising:

an upper surface;

a lip projecting upwardly from the upper surface about an outer perimeter of the base to define an inner area; and a plurality of spacer members extending upwardly from the upper surface positioned within the inner area, the plurality of spacer members configured to space a cover a distance from the upper surface of the base to define an insulating space between the cover and the upper surface of the base, wherein the plurality of spacer members comprise:

an annular rib;

an array of outer radial ribs extending from the annular rib; and an array of inner radial ribs positioned inwardly with respect to the outer radial ribs.

10. A base in accordance with claim 9, wherein the lip further comprises a retaining groove configured to receive the outer edge of the cover to secure the cover to the base.

11. A base in accordance with claim 9 further comprising a central hub and a vent defined through the central hub, the vent configured to channel at least air from within the container to the insulating space, wherein the inner radial ribs extend outwardly from the central hub toward the annular rib.

12. A base in accordance with claim 9, wherein the base further comprises a reservoir defined about a center of the base and a vent defined through the reservoir, the vent configured to channel at least one of air and liquid between the container and the insulating space, wherein the inner radial ribs are spaced a distance from the center of the base.

13. A base in accordance with claim 9 further comprising an annular retainer rib projecting upwardly from the annular rib, the annular retainer rib configured to substantially circumscribe the outer edge of the cover when the cover is coupled to a top surface of the annular rib.

14. A base in accordance with claim 9, wherein the insulating lid is a first insulating lid, the base further comprising:

an annular ridge defined about an inner surface of the lip and extending inwardly from the inner surface, the annular ridge partially defining a retaining groove configured to receive the outer edge of the cover to secure the cover to the base;

at least one lug extending inwardly from the inner surface of the lip and upwardly from the annular ridge, the at least one lug configured to contact a bottom surface of a second insulating lid when the second insulating lid is stacked on top of the first insulating lid.

15. A method for assembling an insulating lid for a container, the lid including a cover and a base, the base including an upper surface, a lip projecting upwardly from the upper surface and extending around an outer perimeter of the base to define an inner area, and a plurality of spacer members extending upwardly from the upper surface positioned within the inner area, the method comprising:

positioning the cover over the plurality of spacer members of the base to define an insulating space between the cover and the upper surface of the base, wherein the plurality of spacer members include an annular rib, an array of outer radial ribs extending from the annular rib, and an array of inner radial ribs positioned inwardly with respect to the outer radial ribs; and coupling the cover to the base to form the lid.

16. A method in accordance with claim 15, wherein the lip of the base includes a retaining groove, coupling the cover to the base further comprising inserting the outer edge of the cover into the retaining groove to secure the cover to the base.

17. A method in accordance with claim 15, wherein the base further includes an annular retainer rib projecting upwardly from the annular rib, and coupling the cover to the base further comprises:

inserting the cover within the annular retainer rib, the annular retainer rib substantially circumscribing the outer edge of the cover; and coupling the cover to a top surface of the annular rib.

* * * * *